US010627187B1

(12) United States Patent
Lin

(10) Patent No.: US 10,627,187 B1
(45) Date of Patent: Apr. 21, 2020

(54) SHOOTING CONTROLLER OF PAINTBALL GUN

(71) Applicant: Kuan Ting Lin, Taichung (TW)

(72) Inventor: Kuan Ting Lin, Taichung (TW)

( * ) Notice: Subject to any disclaimer, the term of this patent is extended or adjusted under 35 U.S.C. 154(b) by 16 days.

(21) Appl. No.: 16/175,483

(22) Filed: Oct. 30, 2018

(51) Int. Cl.
*F41B 11/00* (2013.01)
*F41B 11/723* (2013.01)
*F41B 11/71* (2013.01)
*F41B 11/64* (2013.01)
*F41B 11/62* (2013.01)

(52) U.S. Cl.
CPC ..... *F41B 11/723* (2013.01); *F41B 11/71* (2013.01); *F41B 11/62* (2013.01); *F41B 11/64* (2013.01)

(58) Field of Classification Search
CPC ..... F41B 11/62; F41B 11/72; F41B 11/723; F41B 11/71; F41B 11/64; F41A 3/58; F41A 3/66; F41C 7/11
USPC ..... 124/71–77, 56
See application file for complete search history.

(56) References Cited

U.S. PATENT DOCUMENTS 36,571 A * 9/1862 Moses ..... F41A 3/58 42/40
572,290 A * 12/1896 Clement ..... F41A 3/58 42/40
1,183,644 A * 5/1916 Hill ..... F41B 11/72 124/75
1,545,465 A * 7/1925 Johnstone ..... F41B 11/648 124/67
2,150,288 A * 3/1939 Moller ..... F41B 11/647 124/67
3,153,874 A * 10/1964 Merrill ..... F41A 17/46 42/41
3,229,400 A * 1/1966 Del Pozo, Jr. ..... F41A 17/58 42/36
3,233,601 A * 2/1966 Walther ..... F41B 11/683 124/69
3,318,192 A * 5/1967 Sullivan ..... F41A 3/26 89/142
3,379,188 A * 4/1968 Walther ..... F41B 11/723 124/69
3,561,149 A * 2/1971 Center ..... F41A 3/58 42/41
3,791,256 A * 2/1974 Curtis ..... F41A 3/26 89/185
3,913,553 A * 10/1975 Braughler ..... F41B 11/54 124/73
3,996,684 A * 12/1976 Bauman ..... F41A 3/26 42/16
3,996,685 A * 12/1976 Bauman ..... F41A 9/18 42/17
4,044,487 A * 8/1977 Hutton ..... F41A 35/02 42/16

(Continued)

*Primary Examiner* — Michael D David
(74) *Attorney, Agent, or Firm* — Wang Law Firm, Inc.

(57) ABSTRACT

A shooting controller of a paintball gun includes a mechanical shooting apparatus, an electric shooting apparatus, a pneumatic apparatus, and a switching apparatus. Operating the switching apparatus may switch the paintball gun between a mechanical shooting mode and an electric shooting mode. In the mechanical shooting mode, the mechanical shooting apparatus drives the pneumatic apparatus to shoot a paintball when a trigger is pulled. In the electric shooting mode, the electric shooting apparatus drives the pneumatic apparatus to shoot a paintball when a trigger is pulled.

10 Claims, 19 Drawing Sheets

(56) References Cited

U.S. PATENT DOCUMENTS 4,299,046 A * 11/1981 Atchisson ..... F41A 9/72 42/40
4,541,192 A * 9/1985 Flodman ..... F41C 7/11 42/40
4,660,311 A * 4/1987 Breitfeld ..... F41C 23/14 42/72
4,757,627 A * 7/1988 Saligari ..... A22B 3/02 42/1.12
4,774,929 A * 10/1988 Milliman ..... F41B 11/648 124/76
4,999,939 A * 3/1991 Reese ..... F41A 11/02 42/40
5,062,231 A * 11/1991 Braverman ..... F41A 19/25 42/1.09
5,160,795 A * 11/1992 Milliman ..... F41A 19/53 124/48
5,165,383 A * 11/1992 Ebert ..... F41A 17/50 124/40
5,225,610 A * 7/1993 Uria ..... F41A 11/02 42/40
5,335,581 A * 8/1994 Simon ..... F41A 9/02 89/156
5,404,863 A * 4/1995 Poor ..... F41B 11/62 124/56
5,529,050 A * 6/1996 D'Andrade ..... F41B 11/723 124/1
5,610,362 A * 3/1997 Bouvard ..... F41A 9/45 42/39.5
5,622,160 A * 4/1997 Casas Salva ..... F41B 11/54 124/59
5,711,286 A * 1/1998 Petrosyan ..... F41B 11/55 124/53
5,884,615 A * 3/1999 Casas Salva ..... F41B 11/51 124/31
5,967,133 A * 10/1999 Gardner, Jr. ..... F41B 11/52 124/77
6,119,671 A * 9/2000 Smith ..... F41B 11/57 124/59
6,474,326 B1 * 11/2002 Smith ..... F41B 11/52 124/77
6,539,659 B2 * 4/2003 Casas Salva ..... F41C 7/11 42/75.04
6,578,565 B2 * 6/2003 Casas Salva ..... F41B 11/54 124/40
6,637,310 B2 * 10/2003 Borgwarth ..... F41A 9/45 89/25
6,705,035 B2 * 3/2004 Gussalli Beretta ..... F41A 3/58 42/40
6,766,795 B1 * 7/2004 Sullivan ..... F41B 11/00 124/56
6,907,687 B2 * 6/2005 Rousseau ..... F41A 3/58 42/75.02
7,690,373 B2 * 4/2010 Telford ..... F41B 11/62 124/74
7,814,695 B1 * 10/2010 Keeney ..... F41A 3/66 42/71.01
7,941,954 B2 * 5/2011 Carr ..... F41A 11/04 42/36
8,118,017 B2 * 2/2012 Lammonds ..... F41B 11/62 124/74
8,333,181 B1 * 12/2012 Rice ..... B23P 6/00 124/73
8,839,542 B2 * 9/2014 Dubois ..... F41A 3/66 42/16
2003/0000511 A1 * 1/2003 Moritz ..... F41B 11/57 124/73
2006/0185657 A1 * 8/2006 Gabrel ..... F41B 11/71 124/73
2008/0295818 A1 * 12/2008 Styles ..... F41A 21/48 124/83
2009/0025701 A1 * 1/2009 Douglas ..... F41B 11/71 124/77
2009/0120420 A1 * 5/2009 Tippmann, Jr. ..... F41A 35/00 124/73
2009/0194088 A1 * 8/2009 Tippmann, Jr. ..... F41A 11/00 124/74
2009/0277066 A1 * 11/2009 Burt ..... F41A 3/66 42/6
2014/0060510 A1 * 3/2014 Macy ..... F41B 11/70 124/73
2014/0209082 A1 * 7/2014 Stevens ..... F41B 11/70 124/73

* cited by examiner

SHOOTING CONTROLLER OF PAINTBALL GUN

BACKGROUND OF THE INVENTION

1. Technical Field

The present invention relates to an electric scooter, and more particularly to a shooting controller of a paintball gun, which is capable of switching the paintball gun between a mechanical shooting mode and an electric shooting mode.

2. Description of Related Art

A conventional paintball gun has a pneumatic device to supply a high-pressure gas into the gun to shooting paintballs. Typically, there are two ways of controlling shooting, including a mechanical shooting mode and an electric shooting mode. The paintball guns of the mechanical shooting mode and the paintball guns of the electric shooting mode are totally different in their shooting controllers, so that there was no paintball gun in the market having both of the mechanical shooting mode and the electric shooting mode.

For different players and in different shooting fields, it may need the paintball guns of different shooting modes, so that the providers have to prepare the paintball guns of the mechanical shooting mode and the electric shooting mode for the players to choose. The cost is very high.

BRIEF SUMMARY OF THE INVENTION

In view of the above, the primary objective of the present invention is to provide a shooting controller of a paintball gun, which is capable of switching the paintball gun between a mechanical shooting mode and an electric shooting mode.

In order to achieve the objective of the present invention, a paintball gun includes a gun body; a trigger pivoted on the gun body; a mechanical shooting apparatus provided in the gun body and associated with the trigger; an electric shooting apparatus provided in the gun body and having a switch associated with the trigger and a controlling valve; a pneumatic apparatus provided in the gun body to provide a high-pressure gas to shoot a paintball, wherein the pneumatic apparatus is associated with the mechanical shooting apparatus and the electric shooting apparatus; and a switching apparatus provided on the gun body and connected the trigger to change an initial position of the trigger to switch the paintball gun between a mechanical shooting mode and an electric shooting mode.

The trigger drives the pneumatic apparatus through the mechanical shooting apparatus only when the switching apparatus switches the paintball gun to the mechanical shooting mode pneumatic apparatus and the trigger is pulled, and the trigger drives the pneumatic apparatus through the electric shooting apparatus only when the switching apparatus switches the paintball gun to the electric shooting mode pneumatic apparatus and the trigger is pulled.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
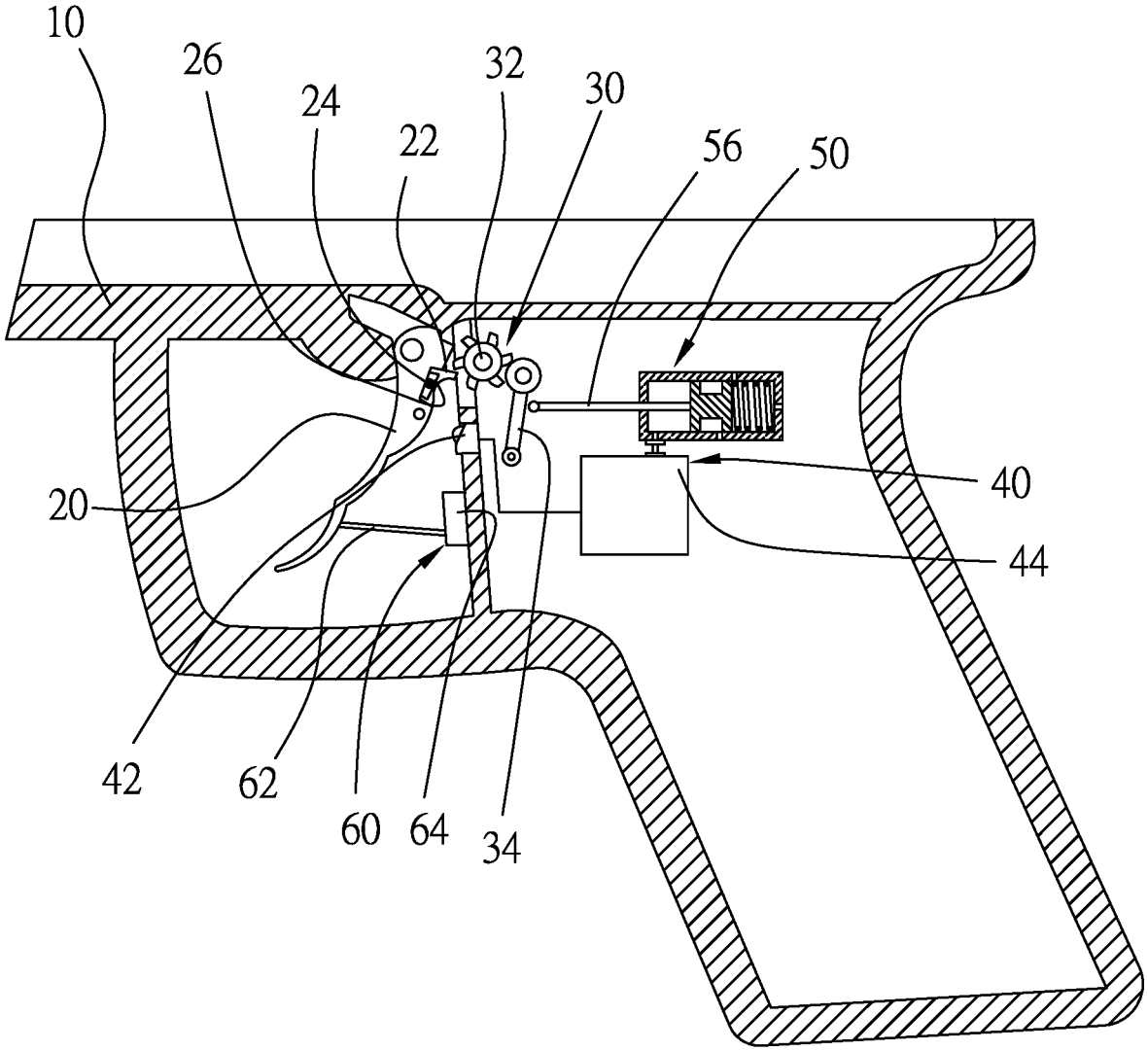
FIG. 1 is a sectional view of a preferred embodiment of the present invention.

As shown in FIG. 1, a shooting controller of a paintball gun of the preferred embodiment of the present invention includes a trigger 20 pivoted on a gun body 10. The paintball gun further includes a mechanical shooting apparatus 30, an electric shooting apparatus 40, a pneumatic apparatus 50, and a switching apparatus 60. The trigger 20 has a triggering member 22 on a side thereof and an elastic member 24 having opposite ends urging the triggering member 22 and the trigger 20. The triggering member 22 further has a concave portion 26 at a side opposite to a side urged by the elastic member 24.

The mechanical shooting apparatus 30 is received in the gun body 10 and beside the trigger 20. The mechanical shooting apparatus 30 includes a gear 32 and a driving member 34, both of which are pivoted on the gun body 10. The gear 32 is adjacent to the triggering member 22 of the trigger 20, and an end of the driving member 34 is adjacent to the teeth of the gear 32.

The electric shooting apparatus 40 has a switch 42 and a controlling valve 44 mounted in the gun body 10. The switch 42 is adjacent to the trigger 20, and is electrically connected to the controlling valve 44. In the present embodiment, the electric controller 44 is a solenoid valve.

Figure 2:
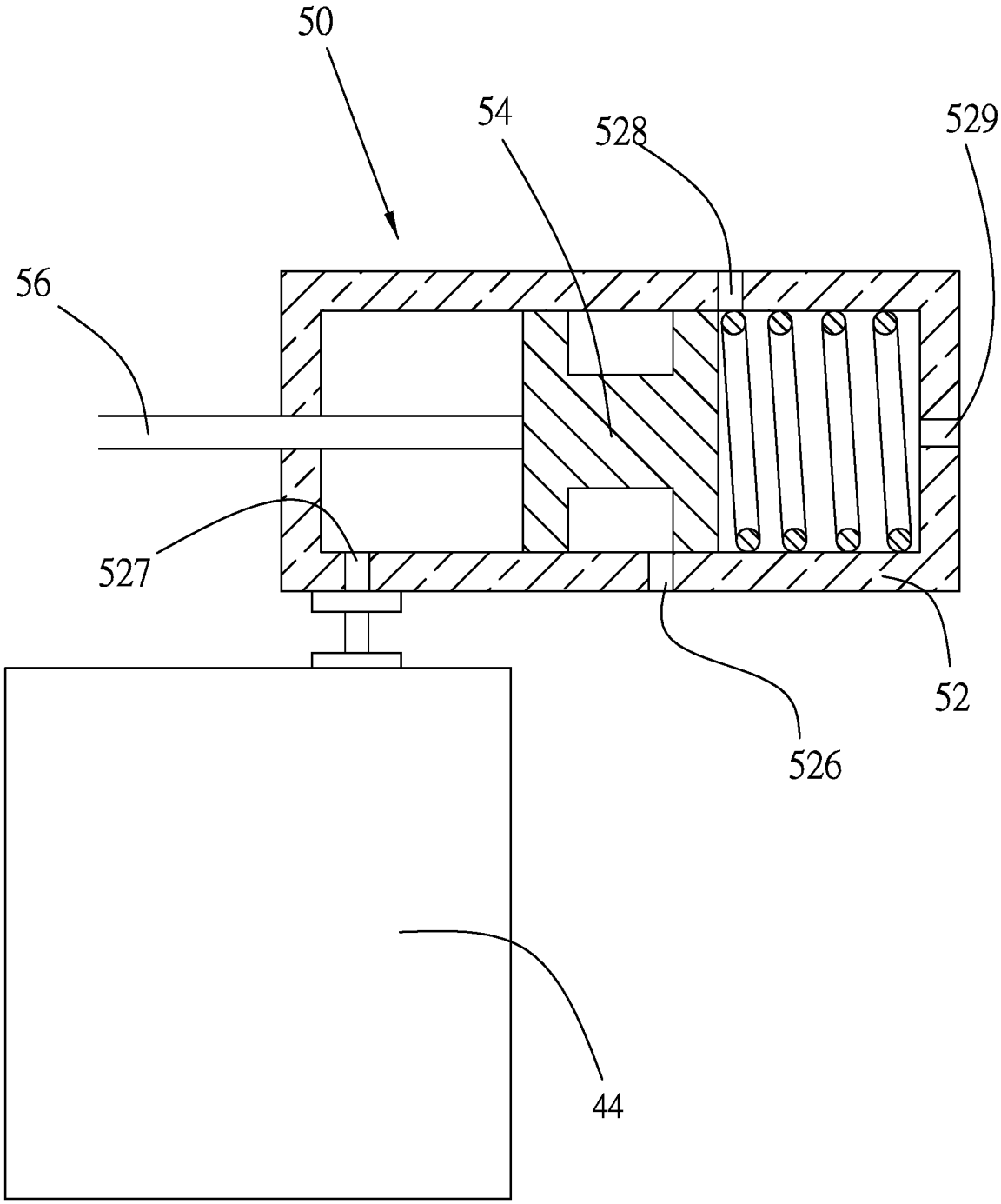
FIG. 2 is a sectional view of the preferred embodiment of the present invention, showing the shooting controller and the pneumatic apparatus.

As shown in FIG. 1, the pneumatic apparatus 50 is beside the mechanical shooting apparatus 30 in association with the driving member 34. As shown in FIG. 2, the pneumatic apparatus 50 includes a cylinder 52, a piston 54, and a shaft 56. The shaft 56 is connected to an end of the piston 54, and the piston 54 movably mounted in the cylinder 52. The cylinder 52 has a shooting gas inlet 526, a driving gas inlet 527, a shooting gas outlet 528, and a exhausting outlet 529. The shaft 56 extends out of the cylinder 52 and has an end adjacent to the driving member 34. The pneumatic apparatus 50 further has an elastic member 58 received in the cylinder 52 and having opposite ends urging the piston 54 and the cylinder 52 to urge the piston to a ready position. The controlling valve 44 of the electric shooting apparatus 40 is connected to the driving gas inlet 527 of the cylinder 52.

As shown in FIG. 1, the switching apparatus 60 is connected to the trigger 20 to return the trigger 20 to an initial position for determining a mechanical shooting mode or an electric shooting mode. The switching apparatus 60 includes a guiding member 62 and a switching member 64. The guiding member 62 has an end connected to the trigger 20, and the switching member 64 is movably mounted in the gun body 10.

Figure 3:
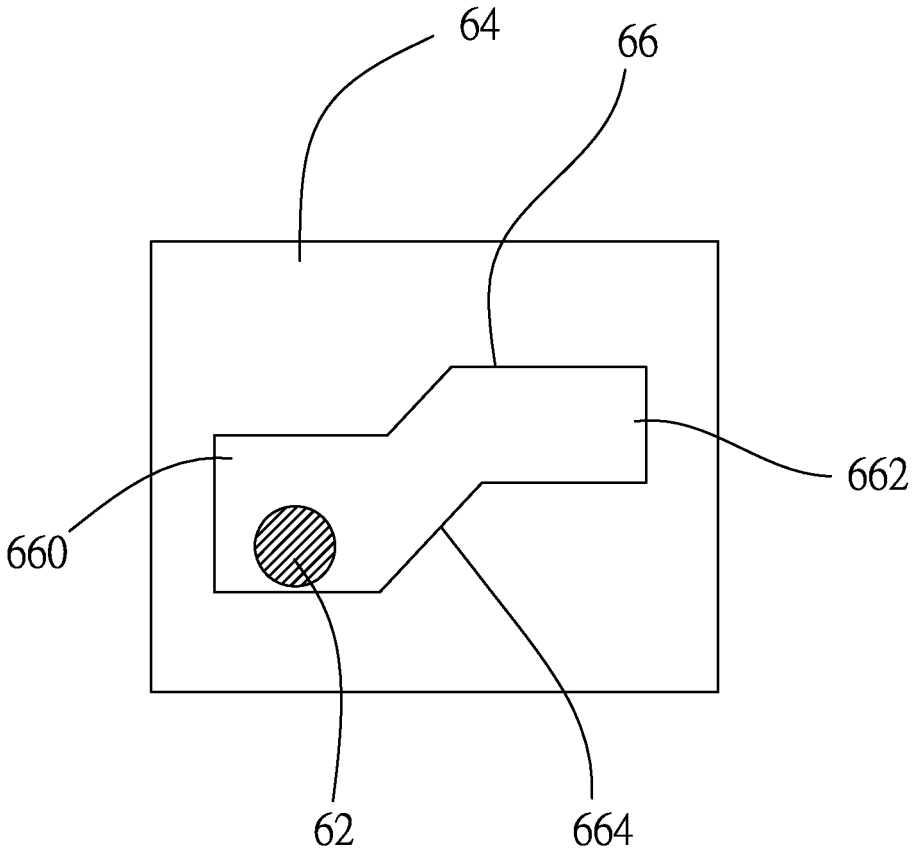
FIG. 3 is a sectional view of the preferred embodiment of the present invention, showing the guiding member and the switching member.

As shown in FIG. 3, the switching member 64 has a slot 66, and the guiding member 62 passes through the slot 66 to move in the slot 66. The slot 66 of the switching member 64 includes a first section 660, a second section 662, and the transitional section 664. The transitional section 664 has opposite ends connected to the first section 660 and the second section 662 respectively. The first section 660 and the second section 662 are located at different heights and have different width.

Figure 4:
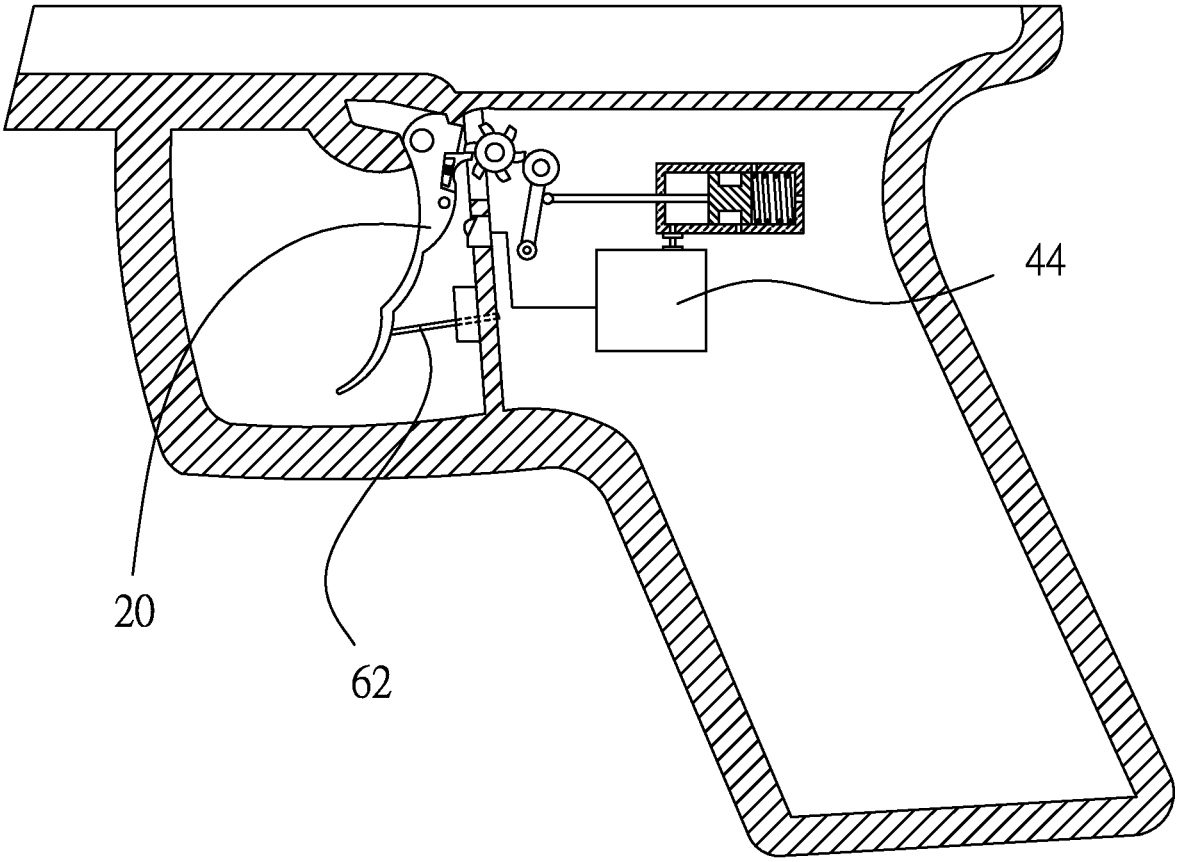
FIG. 4 is a sectional view of the preferred embodiment of the present invention, showing the paintball gun in the mechanical shooting mode.
Figure 5:
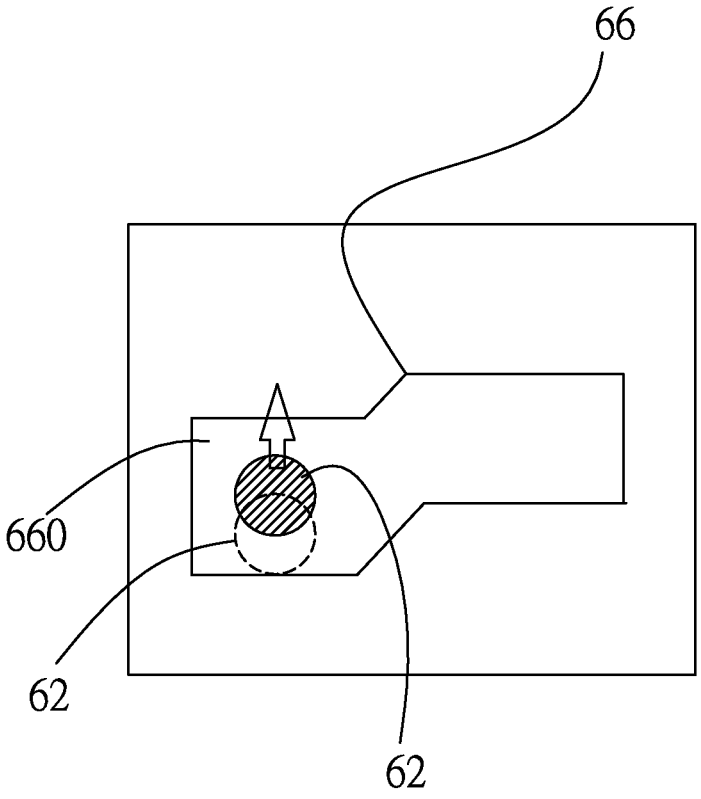
FIG. 5 is a sectional view of the preferred embodiment of the present invention, showing the guiding member being lift in the mechanical shooting mode.

As shown in FIG. 4 and FIG. 5, when the guiding member 62 is received in the first section 660 of the slot 66 of the switching member 62, no power is provided to the controlling valve 44, so that the paintball gun is switched to the mechanical shooting mode. At this time, the guiding member 62 rests against a lower sidewall of the first section 660 of the slot 66, and the guiding member 62 will be lift when the trigger 20 is pulled.

Figure 6:
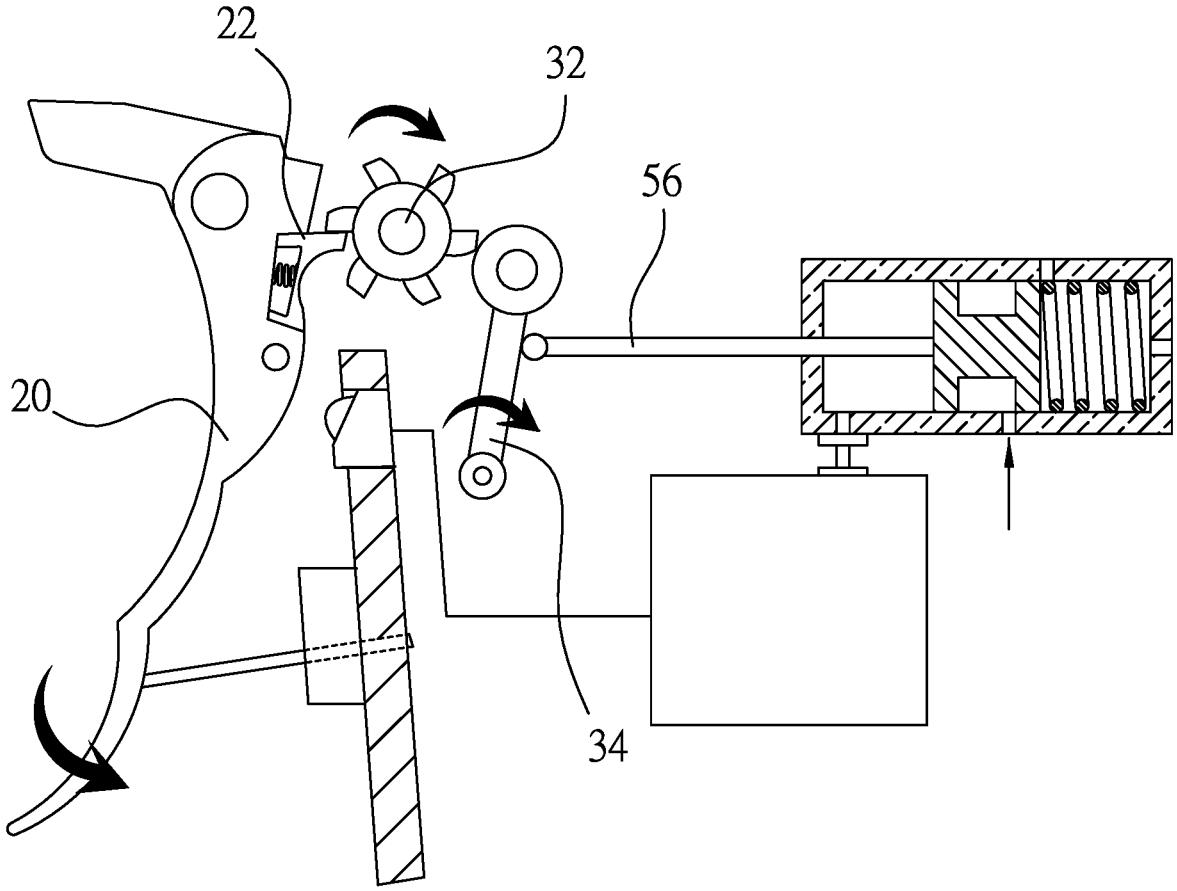
FIG. 6 is a sketch diagram of the preferred embodiment of the present invention, showing the paintball gun in the mechanical shooting mode and the trigger being pulled.
Figure 7:
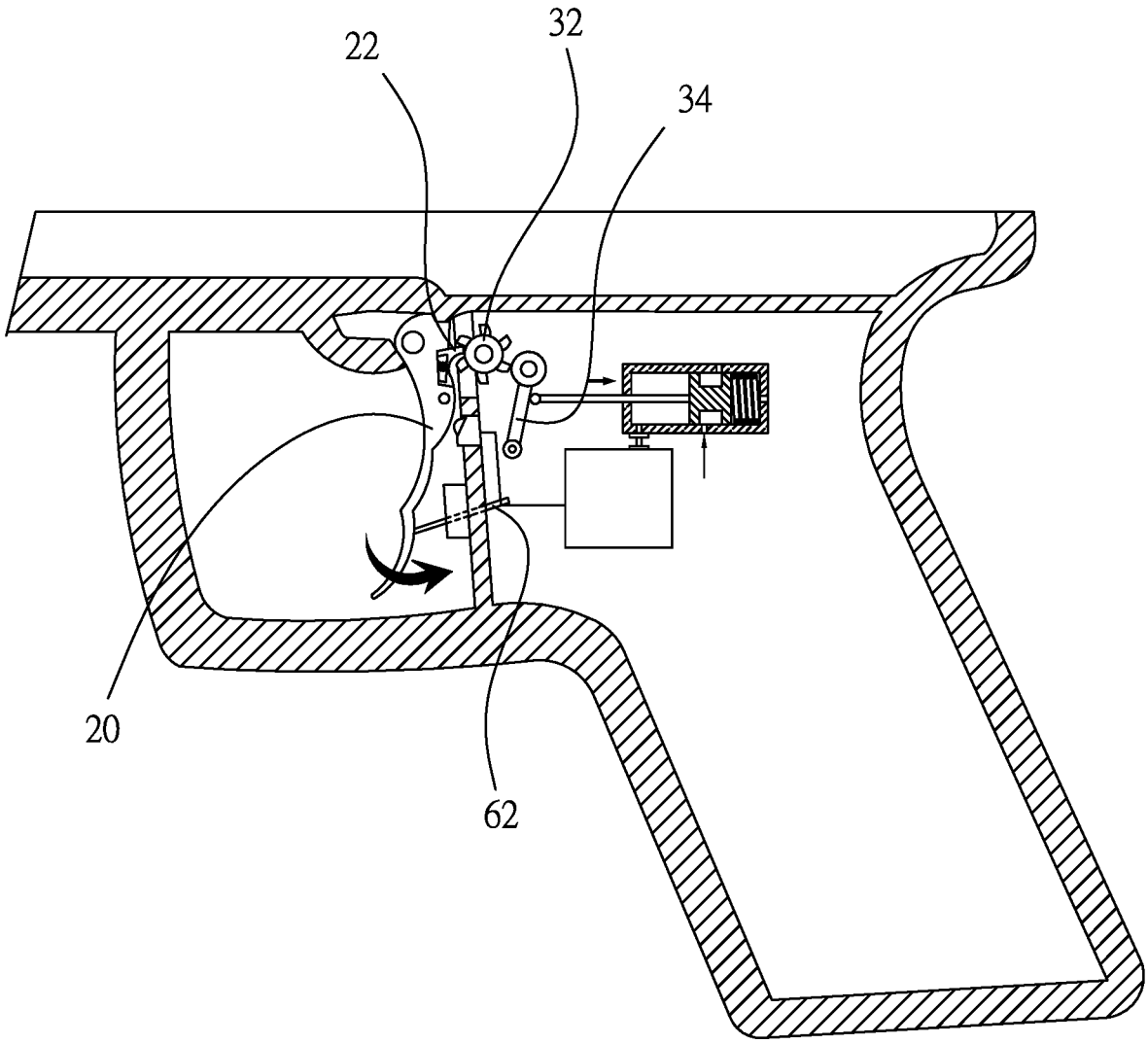
FIG. 7 is a sectional view of the preferred embodiment of the present invention, showing the paintball gun in the mechanical shooting mode and the trigger being pulled.
Figure 8:
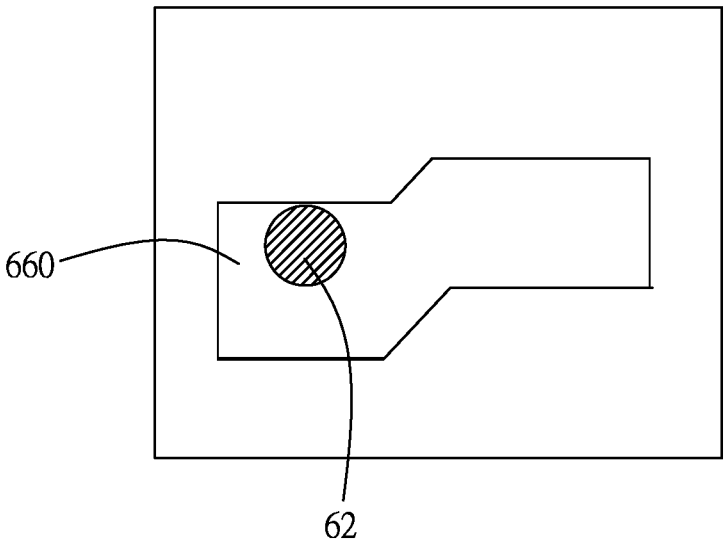
FIG. 8 is a sectional view of the preferred embodiment of the present invention, showing the guiding member in the mechanical shooting mode.

As shown in FIG. 6, when a user pulls the trigger 20, the triggering member 22 pushes the gear 32 to rotate the gear 32 for a predetermined angle, and then the gear 32 pushes the driving member 34 to make the driving member 34 touch the shaft 56.

While the user keeps pulling the trigger 20 to move the guiding member 62 upwards until it touches an upper sidewall of the first section 660 of the slot 66, and to move the driving member 56 through the triggering member 22 and the gear 32.

Figure 9:
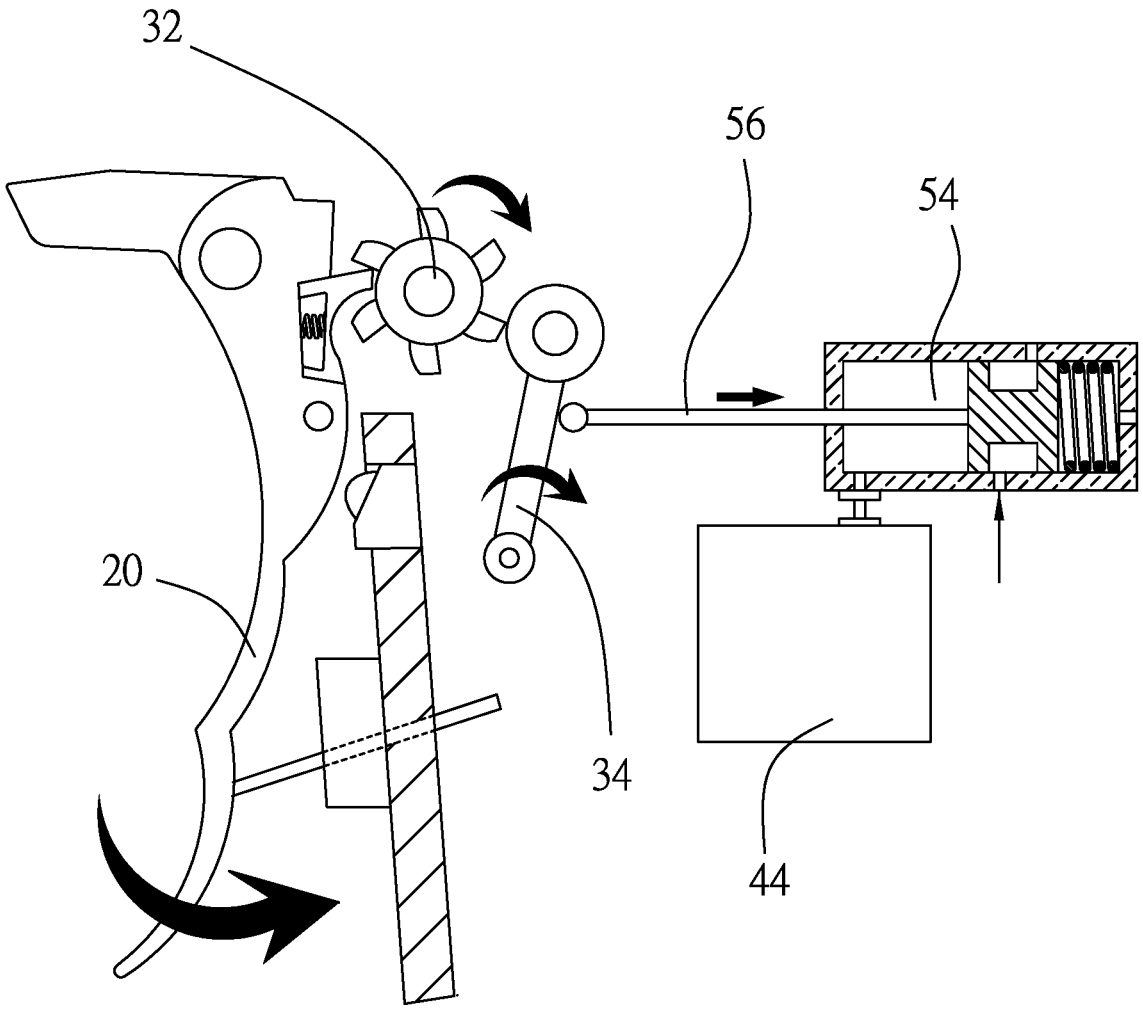
FIG. 9 is another sketch diagram of the preferred embodiment of the present invention, showing the paintball gun in the mechanical shooting mode and the trigger being pulled.
Figure 10:
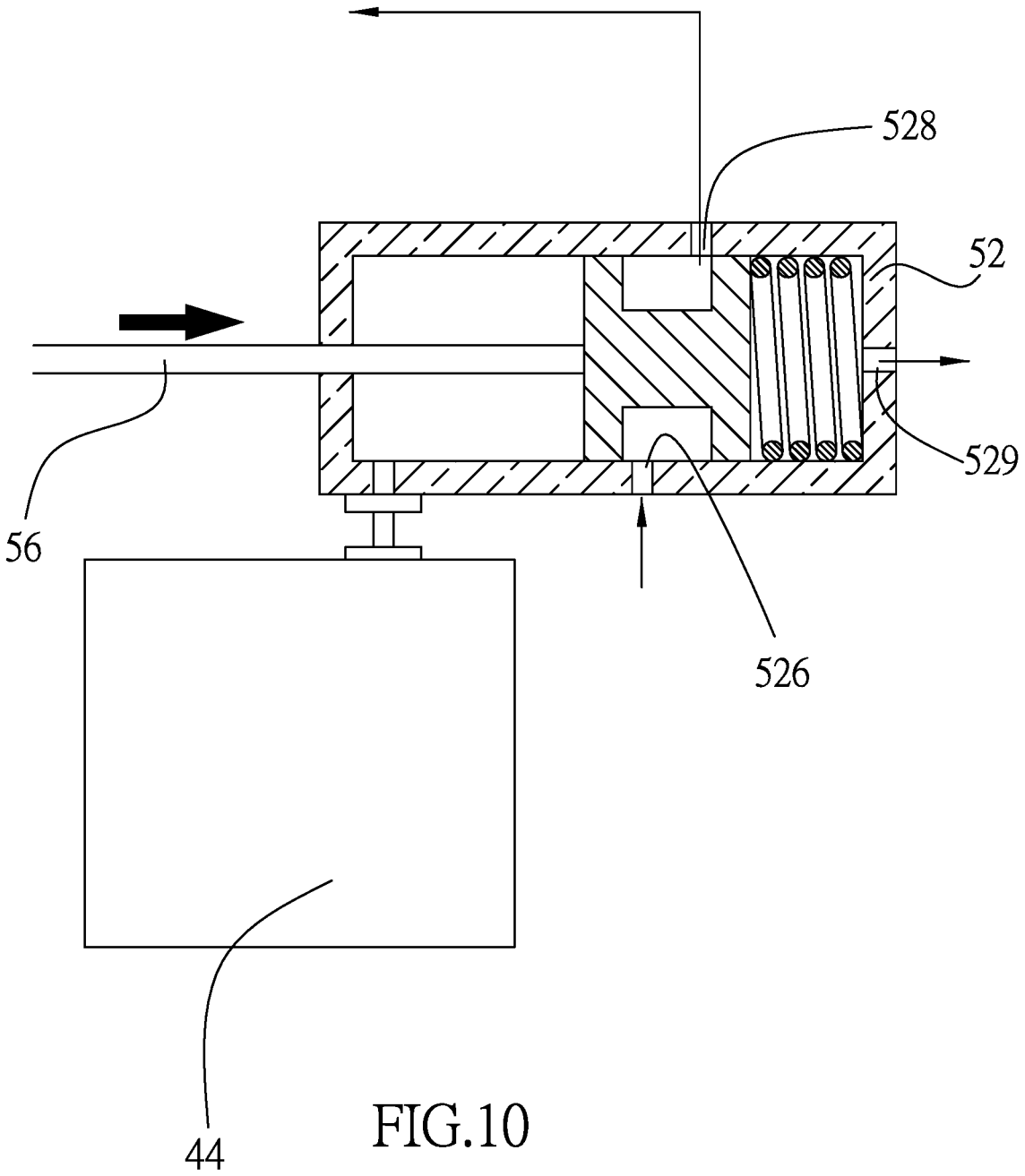
FIG. 10 is a sectional view of the preferred embodiment of the present invention, showing the action of pneumatic apparatus in shooting.

As shown in FIG. 9 and FIG. 10, as a result, the piston 54 will be moved inwards through the triggering member 22, the gear 32, the driving member 34, and the shaft 56 when the trigger 20 is pulled. Since the controlling valve 44 is not activated, no gas is provided to the cylinder 52 through the controlling valve 44. The high-pressure gas is supplied to the cylinder 52 through the shooting gas inlet 526, and comes out via the shooting gas outlet 528 to shoot a paintball (not shown). It is noted that the high-pressure gas is provided to the cylinder 52 through the shooting gas inlet 526 all the time. The piston 54 is moved inwards to exhaust gas in the cylinder 52 through the exhausting outlet 529.

Figure 11:
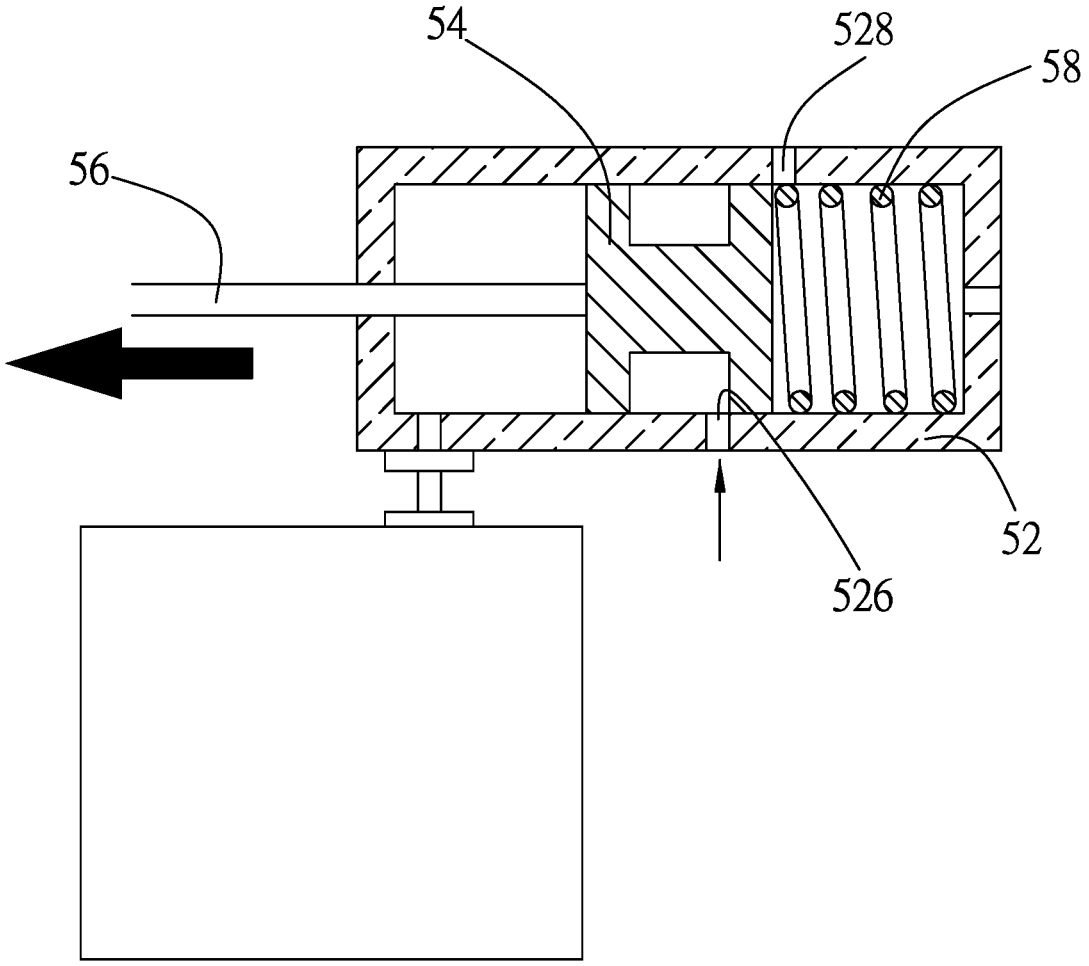
FIG. 11 is a sectional view of the preferred embodiment of the present invention, showing the action of pneumatic apparatus after shooting.

As shown in FIG. 11, when the user releases the trigger 20, the elastic member 58 will push the piston 54 outwards to return the trigger 20 to an initial position through the shaft 56, the driving member 34, the gear 32, and the triggering member 22 of the trigger 20. A force of the high-pressure gas exerted on the piston 54 is smaller than a force of the elastic member 58, so that the piston 54 is moved by the elastic member 58.

Figure 12:
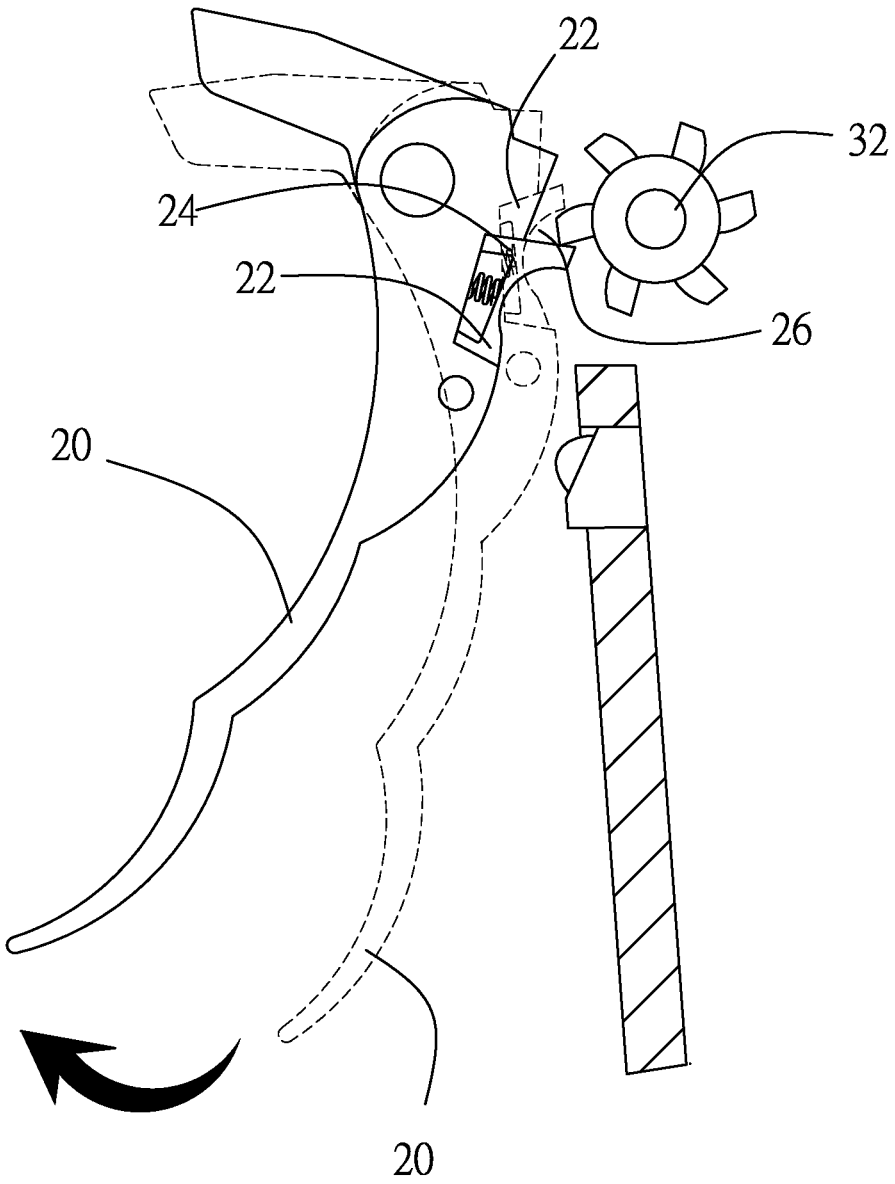
FIG. 12 is a sketch diagram of the preferred embodiment of the present invention, showing the trigger returning after shooting.

As shown in FIG. 12, when the trigger 20 is returning to the initial position, the concave portion 26 of the triggering member 22 of the trigger 20 gives the teeth of the gear 32 a space for the gear 32 to rotate, so that the triggering member 22 is pressed by one of the teeth of the gear 32 and, and the elastic member 24 makes the triggering member 22 like a ratchet to let the tooth of the gear 32 cross over the triggering member 22 to return the trigger 20 to the initial position.

Figure 13:
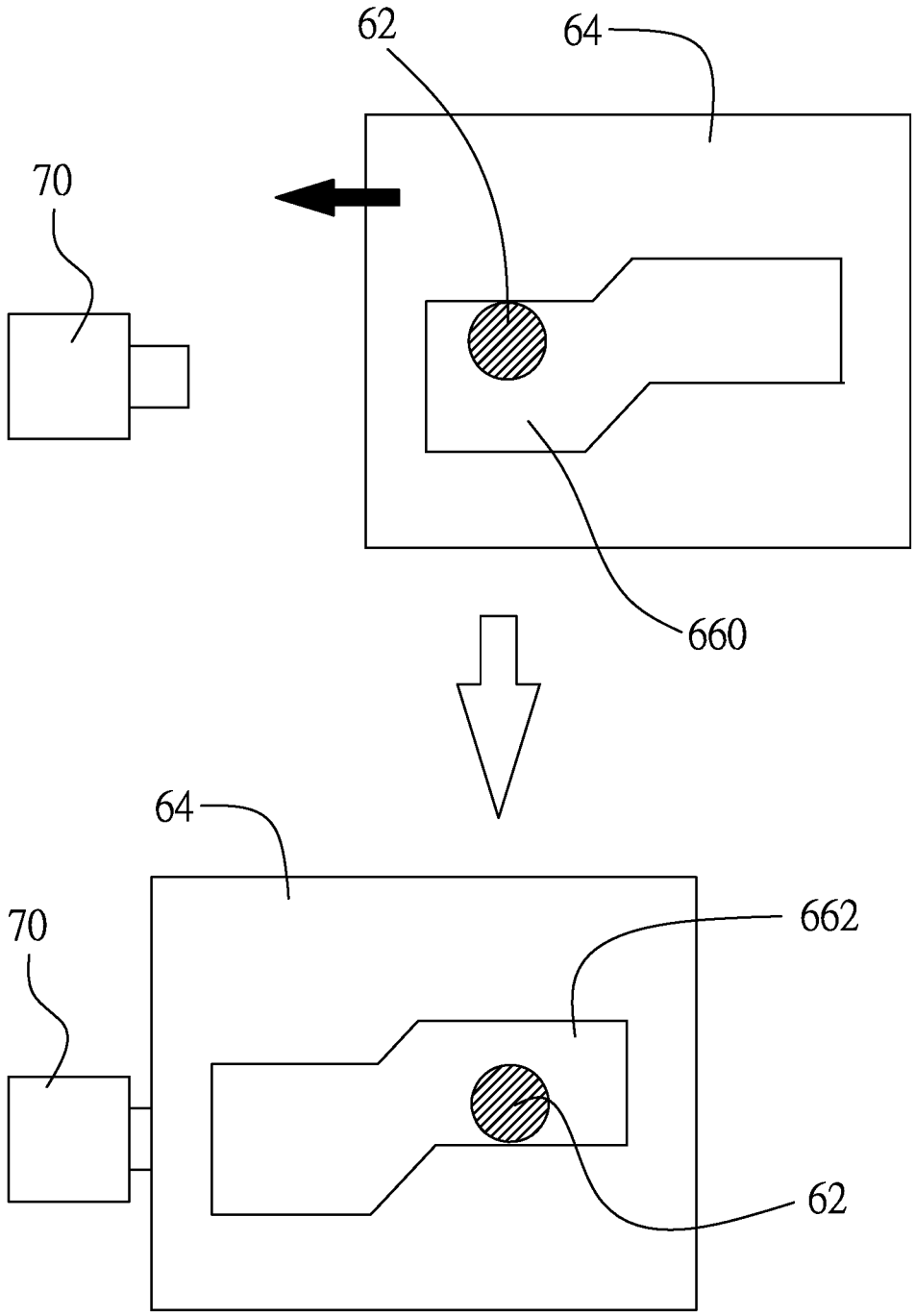
FIG. 13 is a sectional view of the preferred embodiment of the present invention, showing the guiding member in the electric shooting mode.
Figure 14:
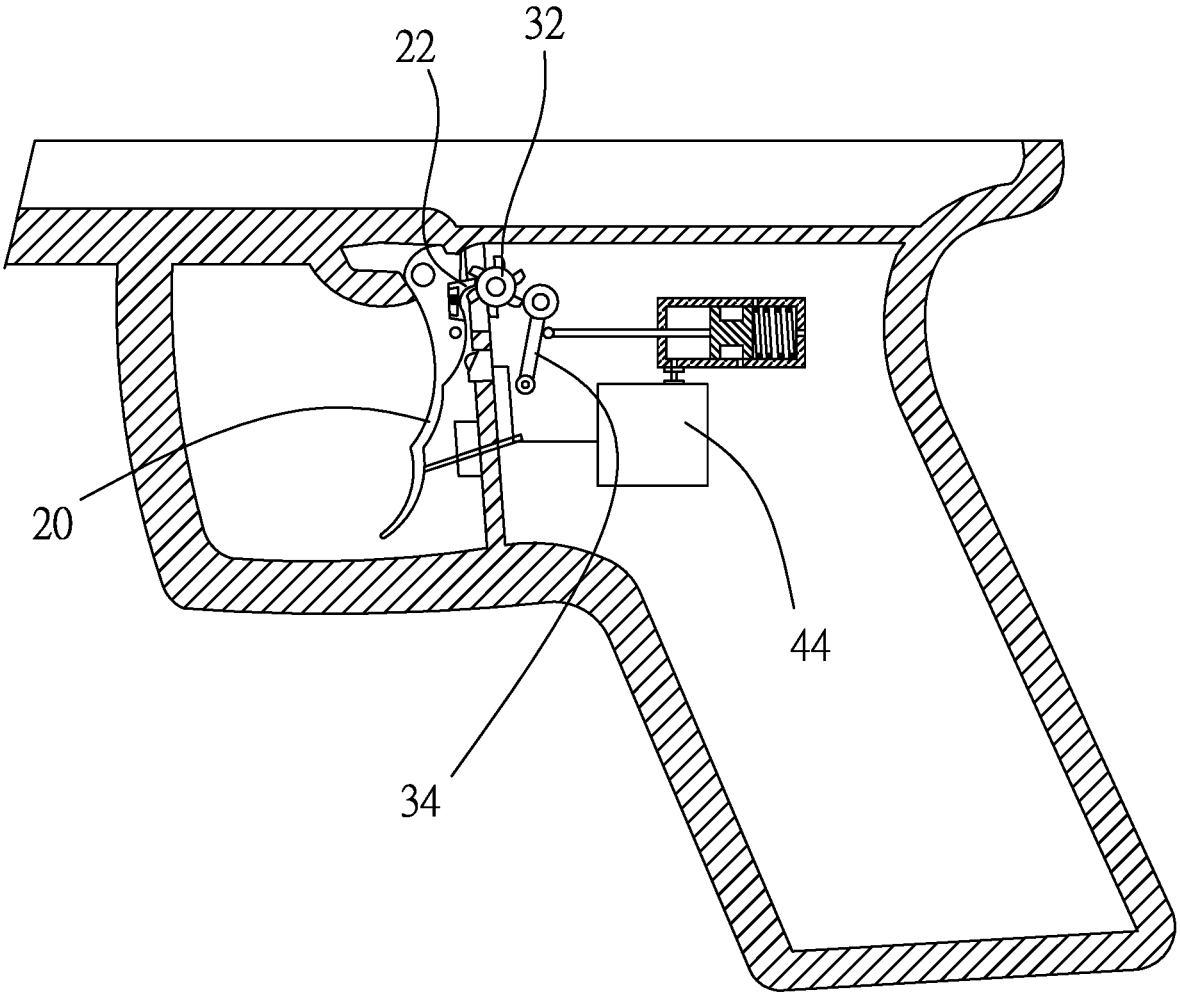
FIG. 14 is a sectional view of the preferred embodiment of the present invention, showing the paintball gun in the electric shooting mode.
Figure 15:
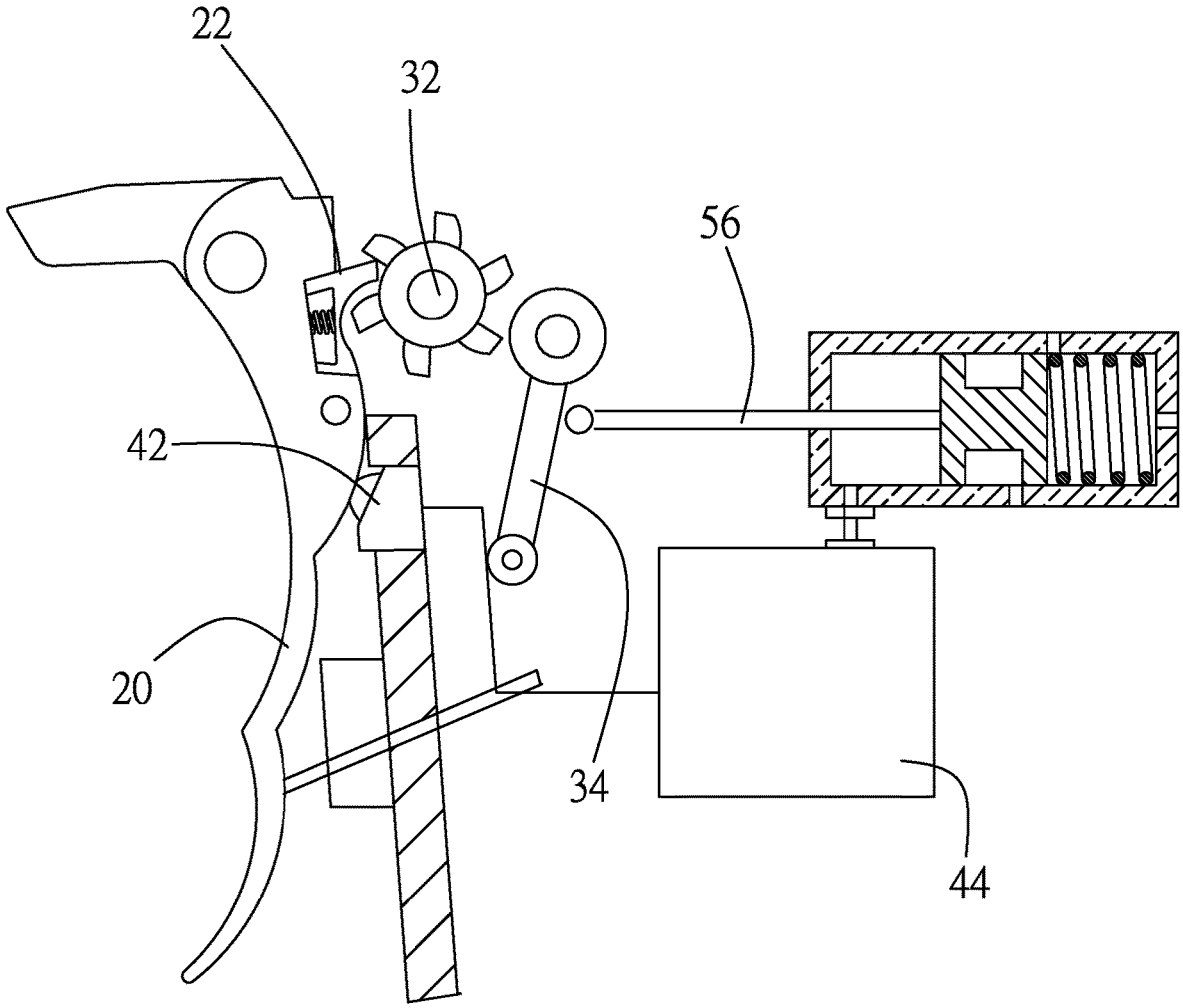
FIG. 15 is a sketch diagram of the preferred embodiment of the present invention, showing the paintball gun in the electric shooting mode and the trigger being pulled.
Figure 16:
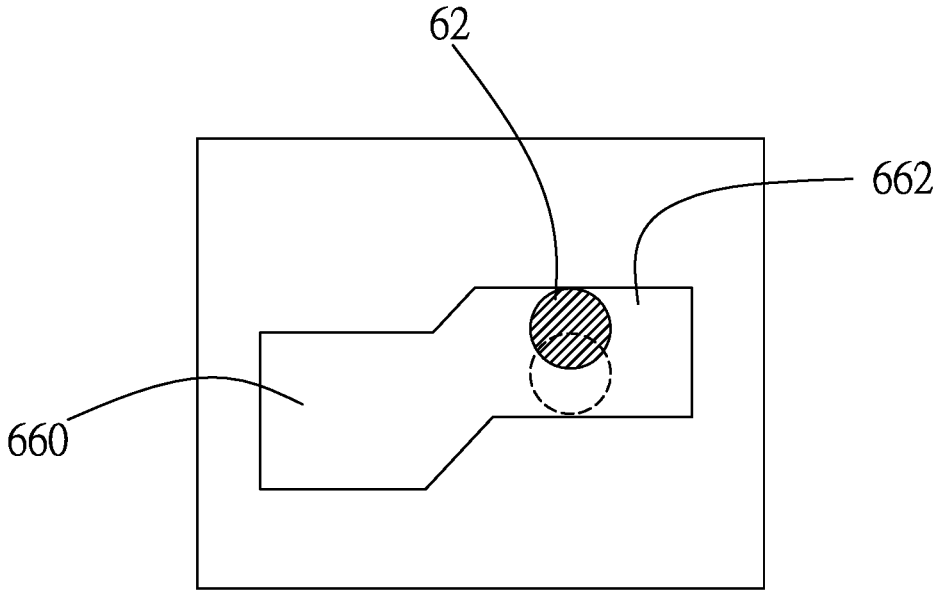
FIG. 16 is a sectional view of the preferred embodiment of the present invention, showing the guiding member being lift in the electric shooting mode.
Figure 17:
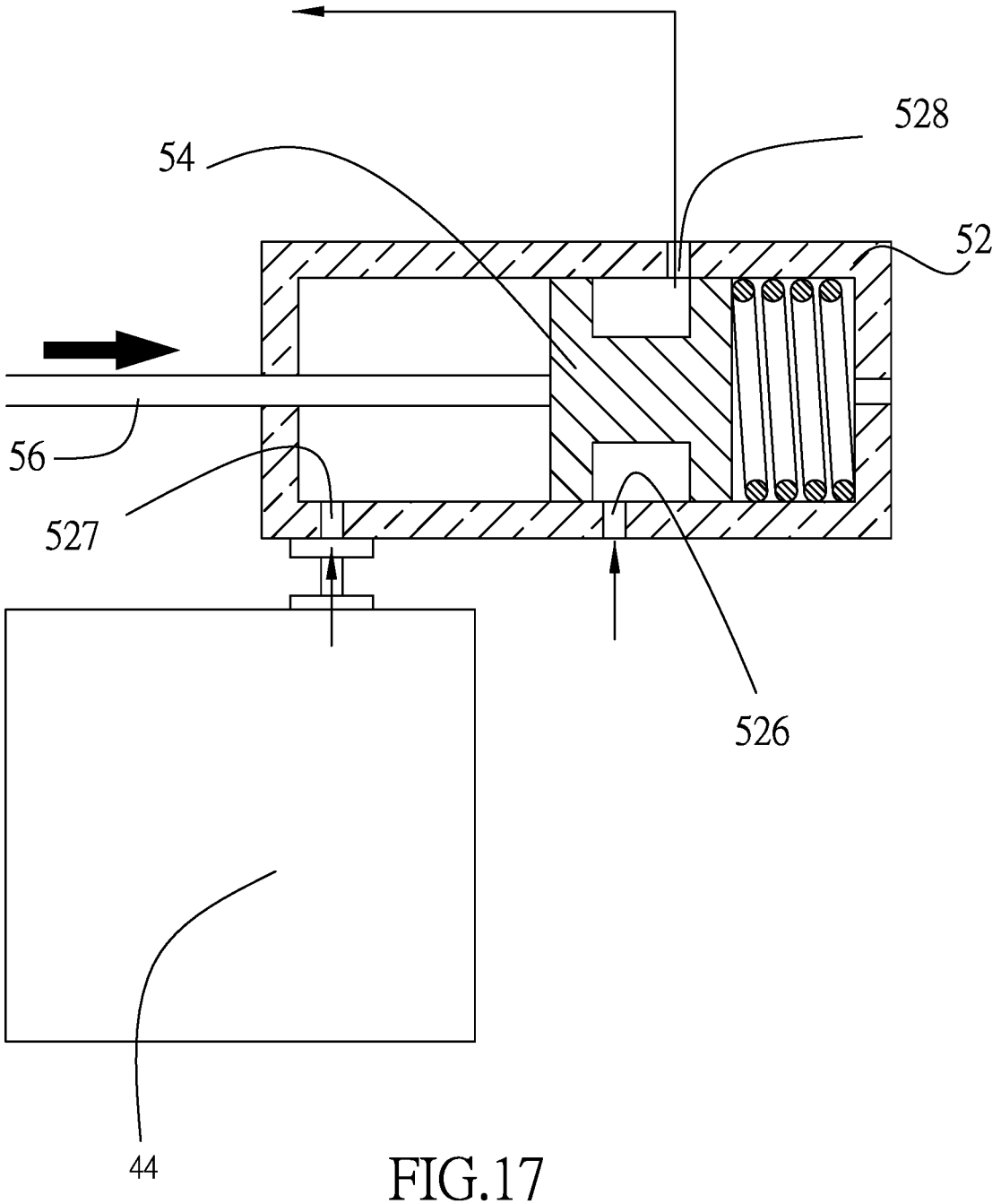
FIG. 17 is a sectional view of the preferred embodiment of the present invention, showing the action of pneumatic apparatus in shooting.

FIG. 13 shows that how to switch the paintball gun to the electric shooting mode from the mechanical shooting mode. The switching member 64 is moved left to shift the guiding member 62 to the second section 662 from the first section 660. At this time, the guiding member 62 touches a lower sidewall of the second section 662, and the paintball gun is switched to the electric shooting mode.

As shown in FIGS. 14, 15, 16, and 17, when a user pulls the trigger 20 until the guiding member 62 is moved upwards to touch an upper sidewall of the second section 662, the trigger 20 touches the switch 42 to activate the controlling valve 44, so that a high-pressure gas is provided to the cylinder 52 via the driving gas inlet 527 to move the piston 54 inwards (after overcoming the force of the elastic member 58) until the shooting gas outlet 528 is communicated with the shooting gas inlet 526. At this time, the high-pressure gas in the cylinder 52 is coming out through the shooting gas outlet 528 to shoot a paintball. The controlling valve 44 is designated to open for a predetermined time (1 or 2 seconds, for example), and then close again after the switch 42 is pressed by the trigger 20.

Since the width of the second section 662 of the slot 66 is smaller than that of the first section 660. A moving distance of the trigger 20 in the electric shooting mode is shorter than that of the trigger 20 in the mechanical shooting mode, so that the gear 43 is rotated by the triggering member 22 for very small angle, and since the driving member 34 is kept a predetermined distance from the shaft 56 at a ready position, the piston 54 is moved by the high-pressure gas through the controlling valve 44 rather than by the driving member 34 in the electric shooting mode.

Figure 18:
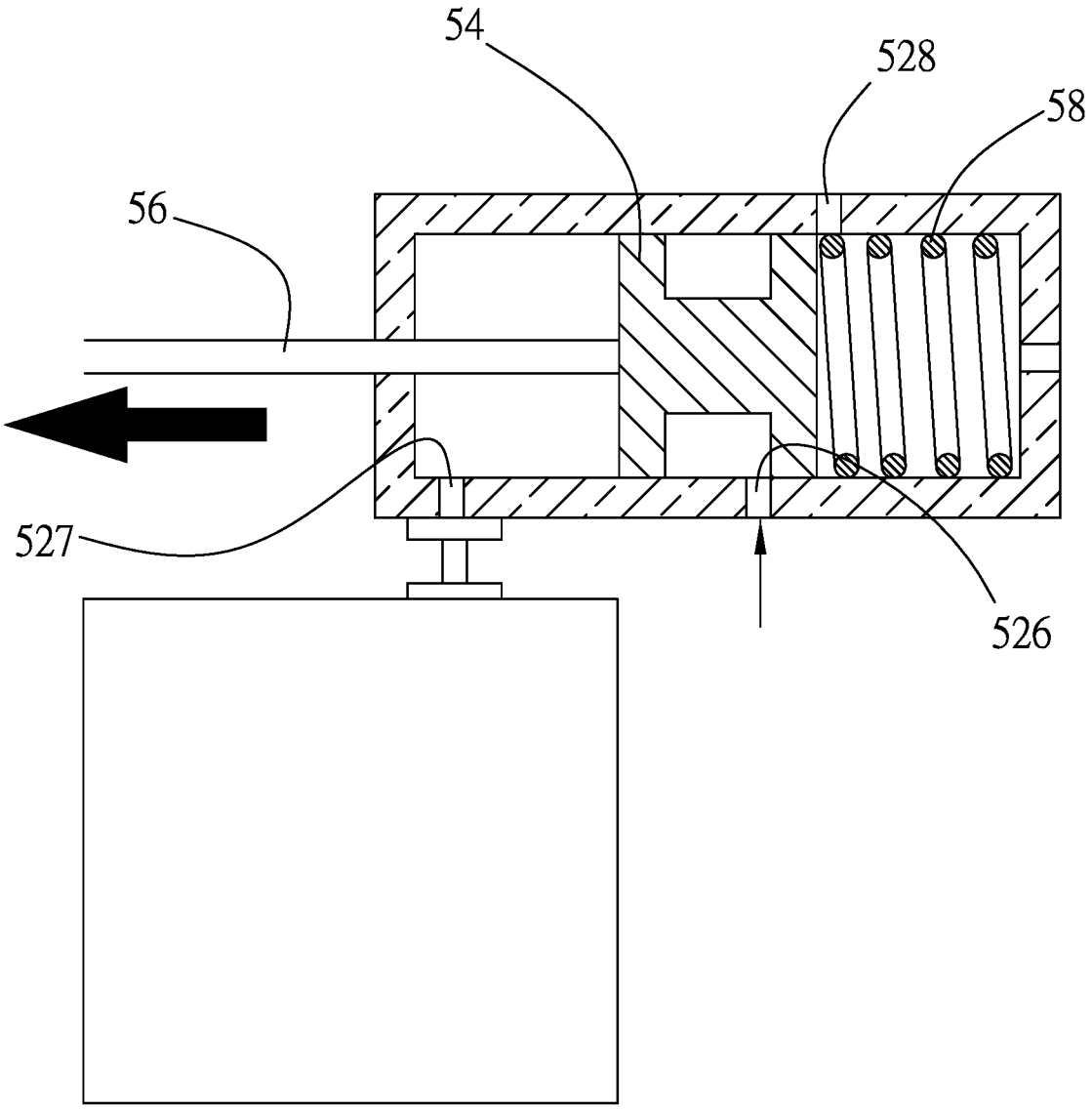
FIG. 18 is a sectional view of the preferred embodiment of the present invention, showing the action of pneumatic apparatus after shooting.

As shown in FIG. 18, when the user releases the trigger 20 or the controlling valve 44 automatically closes, no gas will be supplied to the cylinder 52 via the driving gas inlet 527, so the elastic member 58 takes over to move the piston 54 outwards to seal the shooting gas outlet 528. Now, the paintball gun completes a shooting procedure of the electric shooting mode, and the trigger 20 is ready to be pulled again to shoot another paintball as describe above.

Basically, when the user releases the trigger 20, return of the trigger 20 in the electric shooting mode is achieved by the switch 42 since there is hardly a returning force from the gear 32 to the trigger 20.

Figure 19:
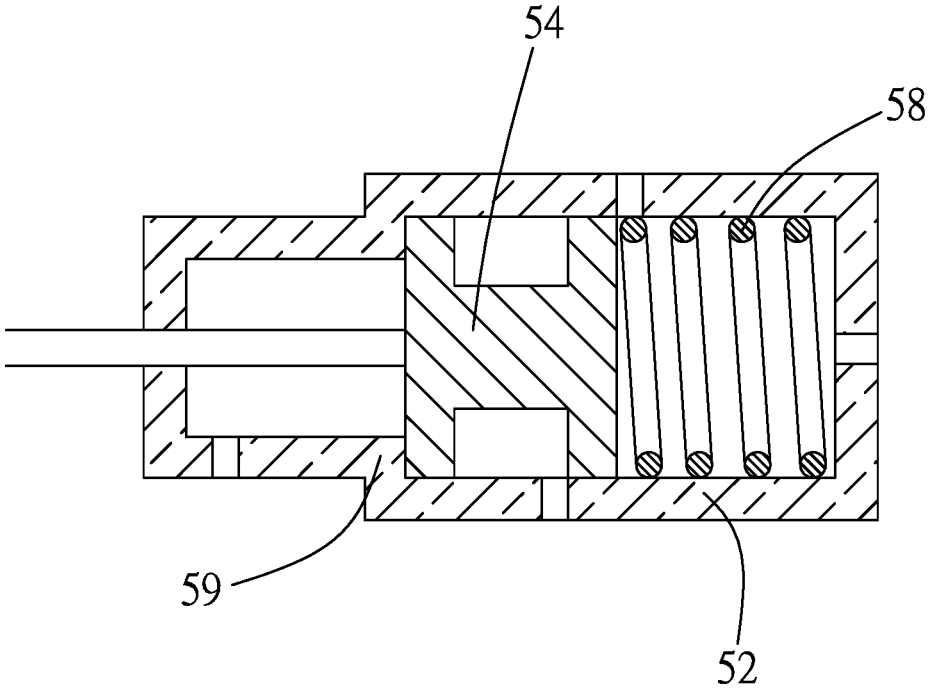
FIG. 19 is a sectional view of the preferred embodiment of the present invention, showing the action of the controlling valve.

An alternate design of the cylinder 52 is shown in FIG. 19, which includes a stop portion 59. A diameter of an inner space of the cylinder 52 is narrowed behind the stop portion 59, so the piston 54 is urged by the elastic member 58 to abut again the stop portion 59 at the ready position.

The paintball gun further includes a power switch 70 (FIG. 13) on the gun body 10, and a power source (not shown) is connected to the controlling valve 44 through the power switch. The power switch is turned on and off by the switching member 64. Precisely, the power switch is turned off when the switching member 64 is switched to the mechanical shooting mode, and is turned on when the switching member 64 is switched to the electric shooting mode.

In conclusion, the present invention provides the guiding member 36 received in the first section 660 or the second section 662 of the slot 66 of the switching member 62 to change the initial position of the trigger 20 and limit a moving range of the trigger 20. The paintball gun is able to be switched between the mechanical shooting mode and the electric shooting mode by moving the switching member 64 according to the player's need.

It must be pointed out that the embodiments described above are only some preferred embodiments of the present invention. All equivalent structures which employ the concepts disclosed in this specification and the appended claims should fall within the scope of the present invention.

What is claimed is:

1. A paintball gun, comprising:

a gun body;

a trigger pivoted on the gun body, the trigger being provided with a triggering member;

a mechanical shooting apparatus provided in the gun body and associated with the trigger, the mechanical shooting apparatus having a gear and a driving member which are both pivoted on the gun body;

an electric shooting apparatus provided in the gun body and having a switch associated with the trigger and a controlling valve;

a pneumatic apparatus provided in the gun body to provide a high-pressure gas to shoot a paintball, wherein the pneumatic apparatus is associated with the mechanical shooting apparatus and the electric shooting apparatus;

a switching apparatus provided on the gun body and connected to the trigger, wherein the switching apparatus is operated to change an initial position of the trigger and to switch the paintball gun between a mechanical shooting mode and an electric shooting mode;

the triggering member is associated with the gear, and the driving member is associated with the gear and the pneumatic apparatus respectively; and wherein in the mechanical shooting mode, the trigger drives the pneumatic apparatus through the mechanical shooting apparatus only when the trigger is pulled, the gear is driven by the triggering member to rotate, and the driving member is moved by the gear to drive the pneumatic apparatus when the trigger is pulled; and in the electric shooting mode, the trigger drives the pneumatic apparatus through the electric shooting apparatus only when the trigger is pulled.

2. The paintball gun of claim 1, wherein the pneumatic apparatus includes a cylinder, a piston, a shaft, and an elastic member; the cylinder has a shooting gas inlet and a shooting gas outlet; the shaft is connected to the piston, and the piston is received in the cylinder for reciprocation; an end of the shaft extends out of the cylinder and is associated with the driving member; the elastic member is receive in the cylinder to urge the piston toward the driving member, so that the piston initially locates at a ready position; the piston closes the shooting gas outlet when the piston arrives at the ready position, and exposes the shooting gas outlet to communicate the shooting gas outlet with the shooting gas inlet when the piston is moved away from the ready position and biases the elastic member; and a high-pressure is provided to the cylinder via the shooting gas inlet and comes out via the shooting gas outlet to shoot a paintball when the piston is moved away from the ready position by the driving member.

3. The paintball gun of claim 1, wherein the switching apparatus includes a guiding member and a switching member; the switching member is movably mounted on the gun body; the switching member has a slot; the guiding member is connected to the trigger and received in the slot of the switching member; the initial position of the trigger is changed by moving the switching member to let the guiding member move in the slot.

4. The paintball gun of claim 3, wherein the slot of the switching member includes a first section and a second section; the first section and the second section are located at different heights of the switching member; the guiding member is received in the first section by moving the switching member to switch the paintball gun to the mechanical shooting mode, and is received in the second section by moving the switching member to switch the paintball gun to the electric shooting mode.

5. The paintball gun of claim 4, further comprising a power switch provided on the gun body and associated with the switching member, wherein the power switch is electrically connected to the electric shooting apparatus, and the power switch is turned on by the switching member when the switch member is moved to receive the guiding member in the second section of the slot, and is turned off by the switching member when the switch member is moved to receive the guiding member in the first section of the slot.

6. The paintball gun of claim 1, wherein the triggering member has a concave portion in association with teeth of the gear to provide the teeth a space for the gear to rotate.

7. The paintball gun of claim 6, wherein the trigger further includes an elastic member; the triggering member is movably connected to the trigger, and the elastic member urges the triggering member toward the gear.

8. The paintball gun of claim 1, wherein the pneumatic apparatus includes a cylinder and a piston received in the cylinder for reciprocation; the cylinder has a shooting gas inlet, a driving gas inlet, and a shooting gas outlet; the piston closes the shooting gas outlet when the piston is moved to a ready position, and exposes the shooting gas outlet to communicate the shooting gas outlet with the shooting gas inlet when the piston is moved away from the ready position; the electric shooting apparatus is connected to the driving gas inlet to provide a high-pressure gas to the cylinder to move the piston away from the ready position when the trigger is pulled; a high-pressure is provided to the cylinder via the shooting gas inlet and comes out via the shooting gas outlet to shoot a paintball when the piston is moved away from the ready position.

9. The paintball gun of claim 2, wherein the cylinder has a stop portion, and the piston abuts against the stop portion when the piston arrives at the ready position.

10. The paintball gun of claim 8, wherein the cylinder has a stop portion, and the piston abuts against the stop portion when the piston arrives at the ready position.

* * * * *